US006640578B2

(12) United States Patent
Wang et al.

(10) Patent No.: US 6,640,578 B2
(45) Date of Patent: Nov. 4, 2003

(54) REFRIGERATOR CONDENSER AND FAN ASSEMBLY

(75) Inventors: Zhijing Wang, Louisville, KY (US); Alexander P. Rafalovich, Louisville, KY (US); Neil K. McDonald, Georgetown, IN (US); James M. Wheatley, Louisville, KY (US)

(73) Assignee: General Electric Company, Schenectady, NY (US)

( * ) Notice: Subject to any disclaimer, the term of this patent is extended or adjusted under 35 U.S.C. 154(b) by 71 days.

(21) Appl. No.: 10/003,076

(22) Filed: Oct. 31, 2001

(65) Prior Publication Data

US 2003/0079491 A1 May 1, 2003

(51) Int. Cl.[7] ..... F25D 17/06
(52) U.S. Cl. ..... 62/428; 62/506
(58) Field of Search ..... 62/428, 452, 454, 62/455, 506, 259.1

(56) References Cited

U.S. PATENT DOCUMENTS 2,952,997 A * 9/1960 Mullin ..... 62/409
3,865,517 A 2/1975 Simmons et al.
4,043,708 A * 8/1977 Greenfield ..... 417/363
4,089,187 A 5/1978 Schumacher et al.
4,257,554 A * 3/1981 Willingham ..... 236/35
5,191,776 A 3/1993 Severance et al.
5,417,401 A * 5/1995 Thompson et al. ..... 248/674
5,592,829 A 1/1997 Kim
5,685,166 A 11/1997 Li
5,696,416 A * 12/1997 Baker et al. ..... 310/91
5,996,361 A 12/1999 Bessler et al.
6,123,051 A * 9/2000 Kubina et al. ..... 123/41.49
6,182,460 B1 * 2/2001 Hernandez et al. ..... 62/262
6,434,962 B1 * 8/2002 Moretti et al. ..... 62/262

* cited by examiner

*Primary Examiner*—Melvin Jones
(74) *Attorney, Agent, or Firm*—H. Neil Houser; Armstrong Teasdale LLP

(57) ABSTRACT

A condenser and fan assembly for a refrigerator is described. In an example embodiment, the assembly comprises a baseplate, a condenser, and a baseplate mounting bracket secured to the condenser for mounting the condenser to the baseplate. The assembly further comprises a fan subassembly comprising a fan motor, a fan blade hub, a plurality of fan blades extending from the fan blade hub. The hub is coupled to the fan motor, and a shroud positioned over the fan blades. A bracket is secured to the shroud. A fan mounting bracket is secured to the condenser for mounting the fan subassembly to the condenser. Specifically, the fan mounting bracket mates with the fan subassembly bracket.

12 Claims, 3 Drawing Sheets

REFRIGERATOR CONDENSER AND FAN ASSEMBLY

BACKGROUND OF THE INVENTION

This invention relates generally to refrigerators and more particularly, to methods and apparatus for assembling a condenser and condenser fan.

Refrigerators typically include a refrigeration circuit including a condenser, a compressor, and an evaporator. The compressor and condenser are typically located in a machinery compartment formed into a refrigerator cabinet below a chilled refrigeration compartment for food storage. A fan induces a forced draft through the machinery compartment and across the condenser and compressor to remove heat from exterior surfaces of the compressor and condenser. See, for example, U.S. Pat. Nos. 4,156,352 and 5,117,523.

The condenser fan position has an impact on refrigerator performance, noise, and serviceability. For example, a larger airflow across the condenser and compressor enhances the cooling performance of the refrigeration circuit in comparison to the cooling performance achieved with a smaller airflow. In addition, a lower airflow resistant condenser and fan assembly provides larger airflow with lower air pressure drop. A lower pressure drop typically results in reduced noise as compared to a condenser and fan assembly having a higher pressure drop.

Further, and with respect to serviceability, repair and replacement servicing performed in the field typically requires access to the condenser fan. In many known refrigerators, the condenser fan mounts on a baseplate or on a wall of a condenser housing. It also is known to mount the fan so that one end of the fan is attached to the condenser and another end of the fan is mounted on a baseplate. Accessing screws that secure the fan to the baseplate, however, is difficult due to the position of the screws relative access openings. In addition, and since the fan is secured to the condenser, dismounting the fan for repair may lead to undesireable movement of the condenser.

BRIEF SUMMARY OF THE INVENTION

On one aspect, a condenser and fan assembly for a refrigerator are provided. In an example embodiment, the assembly comprises a baseplate, a condenser, and a baseplate mounting bracket secured to the condenser for mounting the condenser to the baseplate. The assembly further comprises a fan subassembly comprising a fan motor, a fan blade hub, a plurality of fan blades extending from the fan blade hub. The hub is coupled to the fan motor, and a shroud positioned over the fan blades. A bracket is secured to the shroud. A fan mounting bracket is secured to the condenser for mounting the fan subassembly to the condenser. Specifically, the fan mounting bracket mates with the fan subassembly bracket.

In another aspect, a method for engaging a condenser fan subassembly to a condenser is provided. A first mounting bracket is secured to the condenser, and the condenser fan subassembly includes a second mounting bracket. The method comprises the step of sliding a tab of the second bracket into mating engagement with an indentation in the first bracket.

In yet another aspect, a method for disengaging a condenser fan subassembly from a condenser is provided. A first mounting bracket is secured to the condenser, and the condenser fan subassembly includes a second mounting bracket. Each of the first and second brackets comprises at least one opening, and at least one opening of the first bracket aligns with at least one opening of the second bracket. A screw passes through the aligned openings. The method comprises the step of disengaging the fan subassembly from the first bracket by removing the screw passing through aligned openings.

DETAILED DESCRIPTION OF THE INVENTION

An exemplary embodiment of a condenser and fan assembly is described below in detail. Such assembly can be used in connection with both commercial and domestic refrigerators. Such refrigerators are commercially available, for example, from General Electric Company, Louisville, Ky., 40225, and such refrigerators can be modified to incorporate the assembly described below. The condenser and fan assembly, of course, can be used in many models and types of refrigerators, and is not limited to any one particular refrigerator model nor type.

Figure 1:
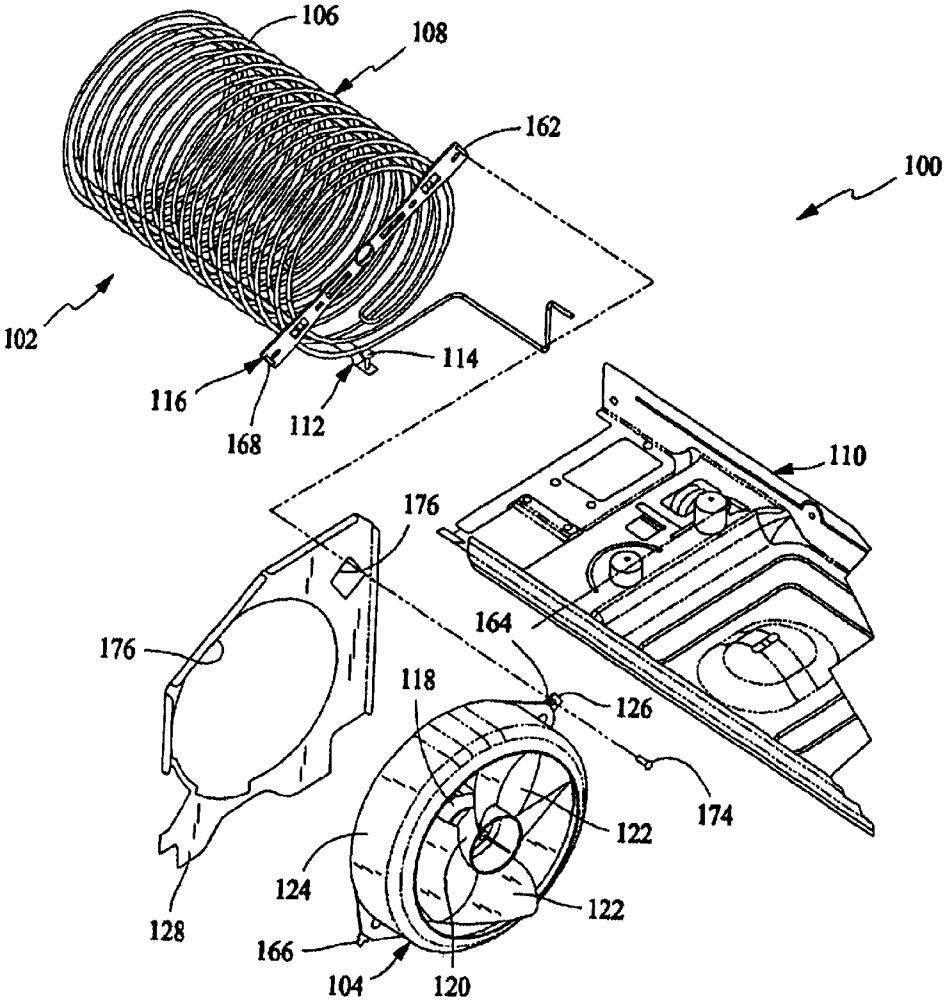
FIG. 1 is an exploded perspective view of a condenser and fan assembly.

FIG. 1 is an exploded perspective view of a condenser and fan assembly 100. As explained above, a refrigerator compressor (not shown), condenser, and condenser fan are typically located in a machinery compartment formed into a refrigerator cabinet (not shown) below a chilled refrigeration compartment for food storage. In the example embodiment, assembly 100 is configured to be located in such a machinery compartment. However, assembly 100 need not be in a machinery compartment.

As shown in FIG. 1, assembly 100 includes a condenser 102 and a fan subassembly 104. Condenser 102, in the example embodiment, includes a tube 106 and at least a portion of tube 106 forms a coil 108. Assembly 100 further includes a baseplate 110, and a baseplate mounting bracket 112 is secured to condenser 102 for mounting condenser 102 to baseplate 110. Specifically, a screw 114 extends through an opening in bracket 112 and engages to baseplate 110 to secure condenser 102 in place relative to baseplate 110. A fan mounting bracket 116 is secured, e.g., by screws, to condenser 102. Bracket 116 is configured for engaging to fan subassembly 104 as described below in more detail.

Fan subassembly 104 includes a fan motor 118, a fan blade hub 120, and a plurality of fan blades 122 extending from fan blade hub 120. Hub 120 is coupled to and driven by fan motor 118. A shroud 124 is positioned over fan blades 122. A bracket 126 is secured, e.g., by screws, to shroud 124.

Assembly 100 further includes a baffle 128 configured to be positioned between condenser 102 and fan subassembly 104. When fan subassembly 104 is operating, baffle 128 forms a barrier against incoming airflow from exhaust air of fan subassembly 104 so that the incoming cooler airflow is not exposed to the hotter exhaust air. Baffle 128 and shroud 124 could be one piece to separate high and low pressure sides, rather than separate pieces as shown in the FIG. 1.

Figure 2:
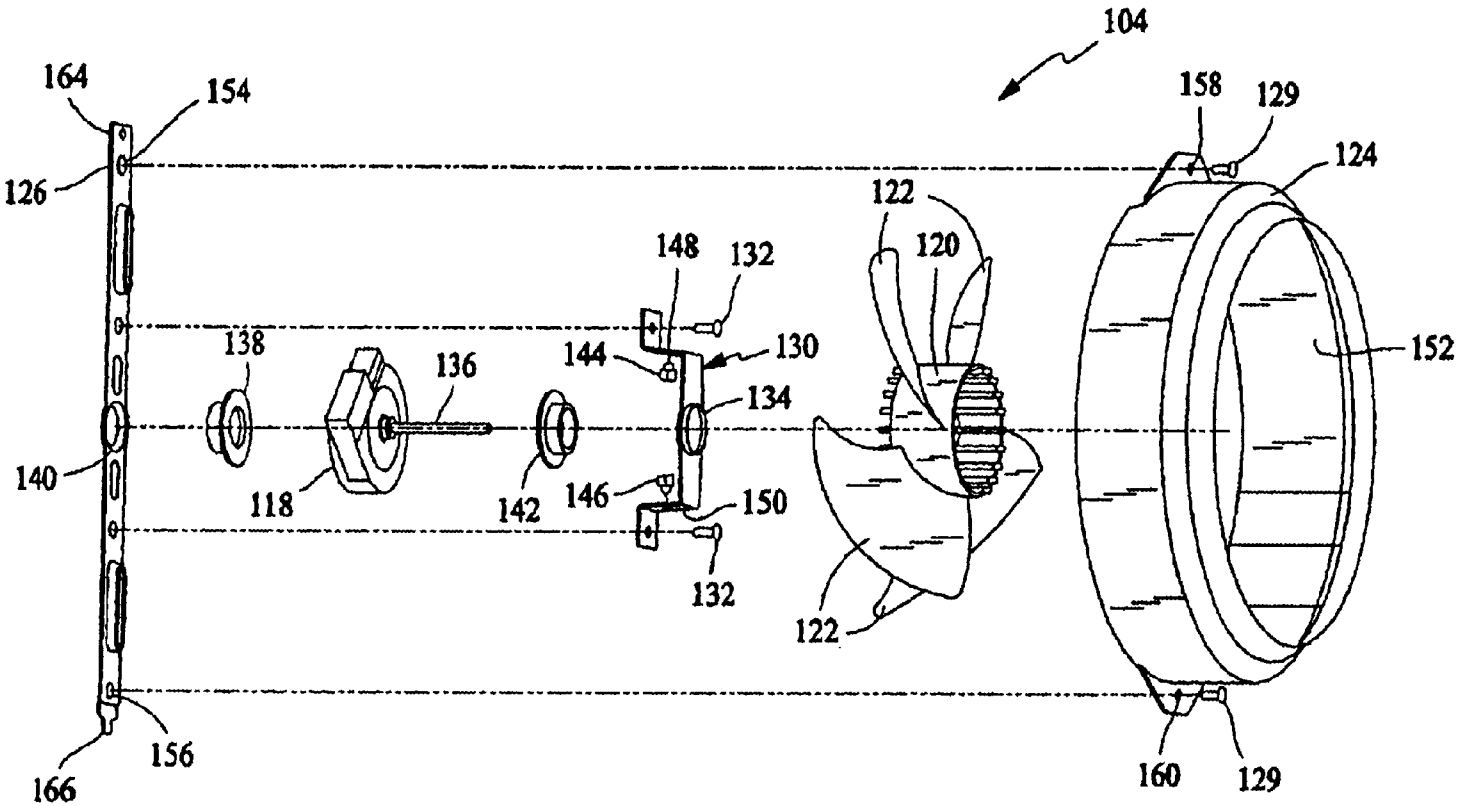
FIG. 2 is an exploded view of the fan subassembly shown in FIG. 1.

FIG. 2 is an exploded view of the fan subassembly shown in FIG. 1. As shown in FIG. 2, fan subassembly 104 includes fan motor 118, fan blade hub 120, and fan blades 122 extending from fan blade hub 120. Hub 120 is coupled to and driven by fan motor 118. Shroud 124 is positioned over fan blades 122. A bracket 126 secured, e.g., by screws 129, to shroud 124.

A motor support bracket 130 is secured to bracket 126 by screws 132. Bracket 130 includes an opening 134 through which fan motor shaft 136 extends. A first bearing 138 is supported in an opening 140 of bracket 126 and a second bearing 142 is supported in opening 134 in motor bracket 130. Positioning caps 144 and 146 extend into openings in arms 148 and 150 of motor bracket 130 and facilitate maintaining motor 118 centered with respect to shroud opening 152. Bracket 126 also includes threaded openings 154 and 156 that align with openings 158 and 160 in shroud. Screws 128 pass through the aligned openings 154, 158 and 156, 160 and are tightened to complete assembling fan subassembly 104.

Figure 3:
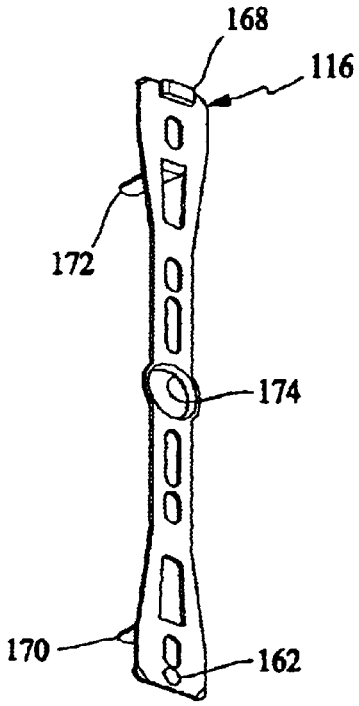
FIG. 3 is a perspective view of the bracket which attaches to condenser as shown in FIG. 1.

FIG. 3 is a perspective view of fan mounting bracket 116, and referring now to FIGS. 2 and 3, bracket 116 includes an opening 162 that aligns with an opening 164 in bracket 126. Bracket 126 also includes a tab 166 that mates with an indentation 168 in fan mounting bracket 116. Bracket 116 further includes extensions 170 and 172 having openings through which screws extend to secure bracket 116 to condenser 108. Bracket 116 also includes an opening 174 that aligns with opening 140 in bracket 126 for at least partially receiving bearing 138.

Figure 4:
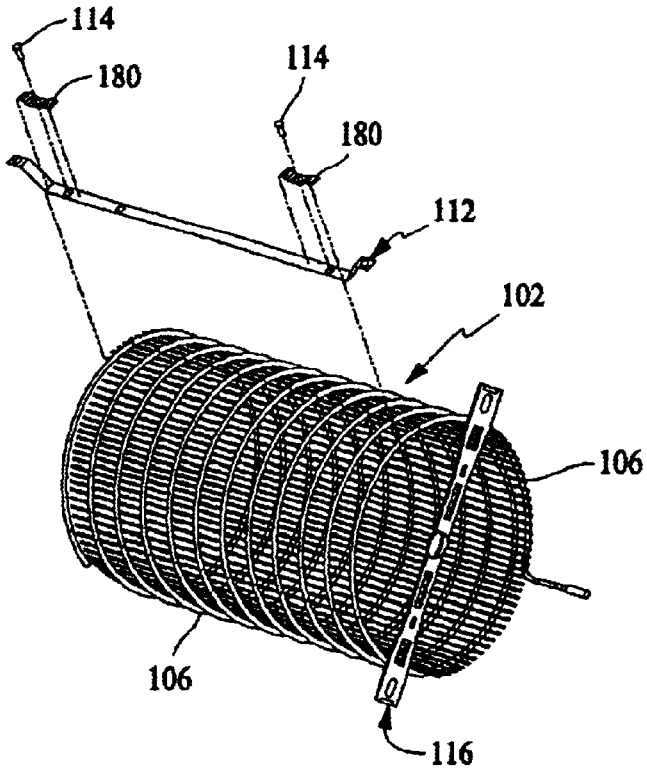
FIG. 4 is an exploded view of the condenser and mounting bracket as shown in FIG. 1.

FIG. 4 is an exploded view of condenser 102 and mounting bracket 112. Bracket 112 is secured to condenser tube 106 by mounting plates 180 which are engaged to bracket 112 and tube 106 by screws 112.

In one embodiment, brackets 116, 126 and 130 and fan hub/blades 120/122 are, for example, a metal such as steel or aluminum. Of course, such components also could be plastic. In one embodiment, shroud 124 is plastic. Of course, shroud 125 could be a metal such as steel or aluminum. Fan motors are well known and commercially available, for example, from General Electric Company, Plainville, Conn. The size and rating of the motor is selected depending on the desired operating characteristics of, for example, the condenser.

To assemble fan subassembly 104 to condenser 102, baffle 128 is positioned between condenser 102 and fan subassembly 104. Tab 166 is then inserted into indentation 168 and openings 162 and 164 are aligned. A screw 174 is then passed through the aligned openings as well as through an opening 176 in baffle 128 and is tightened so that fan subassembly 104 is securely engaged to condenser 102. Baffle 128 is trapped between condenser 102 and fan subassembly 104, and baffle opening 176 aligns with shroud opening 152 and condenser 102 to facilitate air flow through condenser 102.

To easily and quickly remove fan subassembly 104 from condenser 102, screw 174 is disengaged from bracket 116. Fan subassembly 104 is then moved so that tab 166 slides out from indentation 168. Fan subassembly 104 can then be removed and components can of subassembly 104 can be repaired or replaced.

The above described condenser and fan assembly is compact and is not burdensome to assemble. In addition, because the fan subassembly is easily disengaged from the condenser, any repairs or replacement of the fan blades and fan motor can readily and easily performed. Further, the shroud and baffle function so as to prevent airflow leaks, which facilitates ensuring most airflow moves through the condenser for heat exchange. The baffle and shroud also facilitate a good airflow rate and low noise. In addition, the condenser is secured to the baseplate independent of the fan subassembly, and therefore, the condenser is not distorted during normal operation and servicing due to engagement to the baseplate.

While the invention has been described in terms of various specific embodiments, those skilled in the art will recognize that the invention can be practiced with modification within the spirit and scope of the claims.

What is claimed is:

1. A condenser and fan assembly, comprising:

a baseplate;

a condenser;

a baseplate mounting bracket secured to said condenser for mounting said condenser to said baseplate;

a fan subassembly comprising a fan motor, a fan blade hub, a plurality of fan blades extending from said fan blade hub, said hub coupled to said fan motor, a shroud positioned over said fan blades, and a bracket secured to said shroud; and a fan mounting bracket secured to said condenser for mounting said fan subassembly to said condenser, said fan mounting bracket mating with said fan subassembly bracket.

2. An assembly according to claim 1 further comprising a baffle positioned between said condenser and said fan subassembly, said baffle configured to for a barrier against incoming airflow from exhaust air of said fan subassembly.

3. An assembly according to claim 1 wherein said condenser comprises a tube, at least a portion of said tube formed in a coil.

4. An assembly according to claim 1 wherein said fan mounting bracket comprises an indentation, and wherein said fan subassembly bracket comprises a tab for mating with said fan mounting bracket indentation.

5. An assembly according to claim 1 wherein said fan mounting bracket comprises at least one opening, and wherein said fan subassembly bracket comprises at least one opening that aligns with said fan mounting bracket opening.

6. A method for disengaging a condenser fan subassembly from a condenser, a first mounting bracket secured to the condenser, the condenser fan subassembly including a second mounting bracket, each of the first and second brackets comprising at least one opening, at least one opening of the first bracket aligned with at least one opening of the second bracket, and a screw passing through the aligned openings, said method comprising the step of disengaging the fan subassembly from the first bracket by removing the screw passing through aligned opening.

7. A method according to claim 6 wherein disengaging the fan subassembly from the first bracket further comprises sliding a tab of the second bracket out of an indentation in the first bracket.

8. A fan subassembly for engaging to a condenser bracket, the condenser bracket configured to be secured to a condenser, the condenser bracket including at least one opening, said fan subassembly comprising:

a fan motor, a fan blade hub, a plurality of fan blades extending from said fan blade hub, said hub coupled to said fan motor;

a shroud positioned over said fan blades;

and a fan subassembly bracket secured to said shroud, said fan subassembly bracket including at least one opening tat aligns with the condenser bracket opening, said fan subassembly bracket configured to attach to the condenser bracket using one screw.

9. A fan subassembly according to claim 8 wherein a baffle is configured to be positioned between the condenser and said fan subassembly, the baffle configured to for a barrier against incoming airflow from exhaust air of said fan subassembly.

10. A fan subassembly according to claim 8 wherein the condenser bracket comprises an indentation, and wherein said fan subassembly bracket comprises a tab for mating with the fan mounting bracket indentation.

11. A method for engaging a condenser fan subassembly to a condenser, a first mounting bracket secured to the condenser, the condenser fan subassembly including a second mounting bracket, said method comprising the step of sliding a tab of the second bracket into mating engagement with an indentation in the first bracket.

12. A method according to claim 11 wherein each of the first and second brackets comprise at least one opening, at least one opening of the first bracket aligned with at least one opening of the second bracket, said method further comprising the step of inserting a screw through the aligned openings.

* * * * *

UNITED STATES PATENT AND TRADEMARK OFFICE

CERTIFICATE OF CORRECTION

PATENT NO. : 6,640,578 B2
DATED : November 4, 2003
INVENTOR(S) : Wang et al.

It is certified that error appears in the above-identified patent and that said Letters Patent is hereby corrected as shown below:

Column 4,
Line 29, delete “to for a” and insert therefor -- to form a --.
Line 51, between “through” and “aligned” insert -- the --.
Line 67, delete “tat” and insert therefor -- that --.

Column 5,
Line 5, delete “to for a” and insert therefor -- to form a --.

Signed and Sealed this

Twentieth Day of April, 2004

JON W. DUDAS
*Acting Director of the United States Patent and Trademark Office*